US010825642B2

(12) United States Patent
Tuohimaa

(10) Patent No.: US 10,825,642 B2
(45) Date of Patent: Nov. 3, 2020

(54) X-RAY SOURCE WITH IONISATION TOOL

(71) Applicant: Excillum AB, Kista (SE)

(72) Inventor: Tomi Tuohimaa, Kista (SE)

(73) Assignee: EXCILLUM AB, Kista (SE)

( * ) Notice: Subject to any disclaimer, the term of this patent is extended or adjusted under 35 U.S.C. 154(b) by 40 days.

(21) Appl. No.: 16/309,754

(22) PCT Filed: Jun. 18, 2017

(86) PCT No.: PCT/EP2017/064857
§ 371 (c)(1),
(2) Date: Dec. 13, 2018

(87) PCT Pub. No.: WO2017/220455
PCT Pub. Date: Dec. 28, 2017

(65) Prior Publication Data

US 2019/0131103 A1 May 2, 2019

(30) Foreign Application Priority Data

Jun. 21, 2016 (EP) ..... 16175573

(51) Int. Cl.
*H01J 35/20* (2006.01)
*H01J 35/18* (2006.01)

(52) U.S. Cl.
CPC ..... *H01J 35/20* (2013.01); *H01J 35/18* (2013.01); *H01J 2235/082* (2013.01); *H01J 2235/168* (2013.01); *H01J 2235/205* (2013.01)

(58) Field of Classification Search
CPC ..... H01J 35/20; H01J 35/18; H01J 2235/082; H01J 35/168; H01J 35/205
See application file for complete search history.

(56) References Cited

U.S. PATENT DOCUMENTS 3,334,228 A * 8/1967 Mattson ..... H01J 35/10 378/49
4,205,232 A * 5/1980 Maixner ..... H01H 1/021 250/311

(Continued)

FOREIGN PATENT DOCUMENTS

WO 2010083854 A1 7/2010
WO 2013185829 A1 12/2013

OTHER PUBLICATIONS

International Search Report (PCT/ISA/210) dated Oct. 26, 2017, by the European Patent Office as the International Searching Authority for International Application No. PCT/EP2017/064857.

(Continued)

*Primary Examiner* — Blake C Riddick
(74) *Attorney, Agent, or Firm* — Buchanan Ingersoll & Rooney P.C.

(57) ABSTRACT

An X-ray source and a corresponding method for generating X-ray radiation are disclosed. The X-ray source includes a chamber comprising an interaction region, and a first electron source operable to emit a first electron beam, including electrons of a first energy, towards the interaction region such that the first electron beam interacts with a target to generate X-ray radiation. The X-ray source further includes a second electron source adapted to be independently operated to emit a second electron beam including electrons of a second energy for ionising particles in the chamber, and an ion collection tool that is adapted to remove the ionised particles from the chamber by means of an electromagnetic field. By ionising particles and preventing them from moving freely in the chamber, problems related to contamination of the chamber may be mitigated.

17 Claims, 4 Drawing Sheets

(56) References Cited

U.S. PATENT DOCUMENTS 5,991,360 A 11/1999 Matsui et al.
6,452,401 B1 * 9/2002 Derbyshire ..... G01N 23/227 324/452
6,515,408 B1 * 2/2003 England ..... H01J 37/026 313/231.01
2002/0015473 A1 2/2002 Hertz
2003/0198318 A1 * 10/2003 Price ..... H01J 35/065 378/122
2004/0076260 A1 * 4/2004 Charles, Jr. ..... H01J 35/08 378/124
2004/0136499 A1 7/2004 Holland et al.
2005/0205800 A1 * 9/2005 Barnard ..... H01J 37/026 250/423 R
2007/0258563 A1 * 11/2007 Harding ..... H01J 35/08 378/138
2008/0084966 A1 * 4/2008 Aoki ..... G01N 23/223 378/140
2008/0142707 A1 * 6/2008 Barnard ..... G01N 23/223 250/305
2010/0098218 A1 * 4/2010 Vermilyea ..... G21K 1/025 378/144
2010/0148089 A1 * 6/2010 Horsky ..... C23C 14/48 250/425
2010/0177874 A1 7/2010 Hauttmann
2010/0303202 A1 * 12/2010 Ren ..... A61B 6/025 378/62
2011/0038463 A1 2/2011 Behling et al.
2011/0215720 A1 * 9/2011 Larson ..... H01J 27/02 315/14
2011/0220795 A1 * 9/2011 Frosien ..... H01J 37/147 250/307
2012/0207269 A1 * 8/2012 Behling ..... H01J 35/04 378/4
2013/0294576 A1 * 11/2013 Pradhan ..... H01J 35/08 378/44
2013/0315375 A1 * 11/2013 Kleine ..... G01N 23/20008 378/71
2014/0177808 A1 6/2014 Charette et al.
2014/0224996 A1 * 8/2014 Case ..... H01J 35/14 250/396 ML
2014/0326877 A1 * 11/2014 Routh, Jr. ..... H01J 27/16 250/307
2015/0014526 A1 * 1/2015 Bendahan ..... G01V 5/005 250/307
2015/0110252 A1 * 4/2015 Yun ..... G21K 1/06 378/138
2015/0168579 A1 * 6/2015 Perkins ..... H01J 35/045 378/53
2015/0168590 A1 * 6/2015 Perkins ..... H01J 27/04 250/261

OTHER PUBLICATIONS

Written Opinion (PCT/ISA/237) dated Oct. 26, 2017, by the European Patent Office as the International Searching Authority for International Application No. PCT/EP2017/064857.

Notification of Transmittal of International Preliminary Report on Patentability (PCT/IPEA/416) and International Preliminary Report on Patentability (PCT/IPEA/409) dated Sep. 10, 2018, by the European Patent Office as the International Searching Authority for International Application No. PCT/EP2017/064857.

Choi, H.Y., et al., "Acquisition of X-ray images by using a CNT cold emitter", Physics Letters A, vol. 357, No. 1, Aug. 28, 2006, pp. 36-41.

Larsson, D.H., et al., "A 24 keV liquid-metal-jet x-ray source for biomedical applications", Review of Scientific Instruments, vol. 82, No. 12, Dec. 1, 2011, pp. 123701-123701.

* cited by examiner

X-RAY SOURCE WITH IONISATION TOOL

TECHNICAL FIELD

The invention disclosed herein generally relates to generation of X-ray radiation. In particular, it relates to an electron-impact X-ray source with an ionisation tool for ionising particles, and an ion collection tool for removing said ionised particles.

TECHNICAL BACKGROUND

Systems for generating X-rays by irradiating a liquid target are described in applicant's international applications PCT/EP2012/061352 and PCT/EP2009/000481, wherein an electron gun comprising a high-voltage cathode is utilised to produce an electron beam that impinges on a liquid jet. The position in space wherein a portion of the liquid jet is hit by the electron beam during operation is referred to as the interaction region or interaction point. The X-ray radiation generated by the interaction between the electron beam and the liquid jet may leave the vacuum chamber through an X-ray window separating the vacuum chamber from the ambient atmosphere.

Free particles, including debris and vapour from the liquid target, tend to deposit on the window and the cathode. This causes a gradual degradation of the performance of the system, as depositing debris may obscure the window and reduce the efficiency of the cathode. In PCT/EP2012/061352, the cathode is protected by an electric field arranged to deflect charged particles moving towards the cathode. In PCT/EP2009/000481, a heat source is employed to evaporate contaminants deposited on the window.

Even though such technologies may mitigate the problems caused by contaminants in the vacuum chamber, there is still a need for an improved X-ray source having increased useful life as well as increased maintenance intervals.

SUMMARY

It is an object of the present invention to provide an X-ray source addressing at least some of the above shortcomings. A particular object is to provide an X-ray source requiring less maintenance and having an increased useful life.

This and other objects of the technology disclosed are achieved by means of an X-ray source and a method having the features defined in the independent claims. Advantageous embodiments are defined in the dependent claims.

Hence, according to a first aspect of the invention, there is provided an X-ray source comprising a chamber having an interaction region, a first electron source, and a second electron source. The first electron source is operable to emit a first electron beam, comprising electrons having a first energy, towards the interaction region such that the first electron beam interacts with a target to generate X-ray radiation. The second electron source is adapted to be independently operated to emit a second electron beam comprising electrons of a second energy for ionising particles present in the chamber. The second electron source may comprise an electron emitter, an anode electrode for generating an acceleration potential, and a deflector. Further, an ion collection tool may be arranged to remove the ionised particles from the chamber by means of an electromagnetic field.

According to a second aspect, a method for generating X-ray radiation is provided, comprising the steps of:

directing a first electron beam towards an interaction region in a chamber, the electrons of the first electron beam having a first energy for generating X-ray radiation upon interaction with a target in the interaction region;

directing, independently from the first electron beam, a second electron beam comprising electrons of a second energy for ionising particles in the chamber, such that the second electron beam interacts with debris generated from the interaction between the first electron beam and the target to ionise at least some of the particles in chamber; and removing the ionised particles from the chamber by means of an electromagnetic field.

Vapour, debris and other particles may be generated as the first electron beam interacts with the irradiated object in the interaction region. It will however be appreciated that free particles or other contaminants may originate from other parts of the X-ray source, such as the housing defining the chamber or sealings or bushings separating the chamber from the ambient atmosphere. Both neutral and electrically charged particles may be present in the chamber. The charged particles may e.g. be generated in the vicinity of the first electron beam, mainly upstream of the interaction region (as used in this disclosure, the terms "upstream" and "downstream" refer to the direction in which the first electron beam propagates). The charged particles may also recombine with each other to form neutral particles.

The charged particles may be particularly detrimental to the cathode as positive ions may be accelerated towards the cathode and cause sputtering damage and corrosion. Neutral contaminants, such as e.g. vapour, may condense on the cathode and form droplets or larger deposits that degrade the cathode over time. This degradation process may however be significantly slower than the degradation caused by the charged particles. The charged and the neutral contaminants may also be detrimental to the X-ray window, on which they may deposit and thereby absorb X-rays, thus reducing the efficiency of the window.

Thus, the present invention is based on the realisation that by combining an ion collection tool with an ionising tool, of which the second electron source is a preferred embodiment, for ionising neutral particles, the amount of debris reaching the sensitive parts of the X-ray source can be further limited. Thus, the gradual degradation of the performance of the X-ray source, caused by deposits and contaminants obscuring the window and reducing the efficiency of the cathode, may be mitigated.

Even though the ion collection tool per se may be efficient for the purpose of controlling (e.g., reversing, trapping or diverting) the transport of particles towards the cathode or the X-ray window, the electrically neutral particles may, as mentioned above, still propagate relatively unaffected within the chamber and degrade sensitive parts of the X-ray source. The use of the ionising tool is therefore particularly advantageous for trapping also the neutral particles, which may be electrically charged as they interact with the ionising tool and thereby be allowed to be trapped by the ion collection tool. The use of an ionising tool is also advantageous over prior art technologies utilising e.g. heating means for evaporating material that has deposited on the X-ray window, as heaters may add cost and complexity to the system.

The ionisation tool may, alternatively or additionally, comprise e.g. an electric field, an ion gun, or a laser. Preferably, the performance of the ionisation tool may be adjusted to maximise the ionisation cross section for debris generated from the interaction between the first electron beam and the target.

The ionisation tool may also reduce the effects of recombination by re-ionising recombined particles so that they can be captured by the ion collection tool.

The ionisation tool may e.g. be adapted to ionise particles in the vicinity of the interaction region, the X-ray window, and/or the first electron source (e.g., cathode region). Further, the ionisation tool may ionise particles at positions between the interaction region and the X-ray window, and/or positions upstream of the interaction region, i.e., between the interaction region and the cathode region. By ionising particles between the interaction region and the X-ray window, at least some of the contaminants are allowed to be diverted before they reach the X-ray window. By ionising particles between the interaction region and the cathode region, neutral particles may be ionised and diverted before they propagate further towards the first electron source. Hence, several different configurations are conceivable and may be selected e.g. depending on where in the chamber the particles are generated, from where they should be removed, the position of the ion collection tool, etcetera.

In an embodiment, the ionization tool may be operated and controlled independently of the first electron source. Thus, the capability of the ionization tool to ionise a particle in the chamber may be adjusted and controlled independently from the operation of the first electron source, the X-ray radiation generated, the amount of backscattered electrons present in the chamber, and/or the number of particles generated from the interaction region. This may provide an advantage in that the rate of ionization of the particles can be adjusted without interfering with the X-ray production. According to a particular embodiment, the ionization tool may comprise a second electron source, such as an electron gun, comprising an electron emitter, an anode electrode generating an acceleration potential to provide the desired electron energy, and a deflector to direct the outgoing electron beam towards the intended region. In an embodiment, said electron emitter may be formed of a heated filament, utilising so called thermionic emission. The filament may be heated by passing a heater current through the filament. By increasing the temperature of the filament, i.e. by raising the current and thus providing more heat, the number of emitted electrons may be increased, i.e. the electron current increases.

The ionisation tool may further comprise a controller to adjust the ionisation parameters, like electron current, electron energy, and electron beam direction, to increase the ionisation rate. The ion collection tool may have the ability to measure the number of ionised particles collected during a specific time thus providing a rate at which particles are collected which may be used as an estimate of the ionisation rate. These measurements may be used as a basis for adjusting the ionisation parameters to increase the ionisation rate. This may be performed by arranging the controller to adjust the ionisation parameters so that a measure of the number of ionized particles provided by the ion collection tool is increased. To enable the required adjustments without impairing the performance of the X-ray source the ionisation tool settings may be independent of the first electron source as discussed above.

The ion collection tool may comprise functionality for directing or guiding charged particles away from sensitive parts of the X-ray source. It should be noted that the attraction of positive ions to the first electron beam can affect the shape and/or direction the beam. If the ion collection tool is arranged in such a way that this effect is reduced, control of the first electron beam may be somewhat simpler.

The particles may furthermore be collected and transported either to a container or to be re-circulated to form part of the target again. The ion collection tool may also comprise means for measuring the amount of particles collected. This could be realised with an ammeter or similar current measuring device measuring the current produced by the charged particles. This current is related to the production rate of debris.

According to some examples, the electric field may be generated between two or more electrically conductive elements, or electrodes, of which at least one may be electrically connected to, and/or form part of, at least a portion of a housing enclosing the chamber. The housing may thus comprise one or several electrically conductive elements, such as an assembly of metallic vacuum envelope parts. The housing may be monolithic, consisting of a single conductive element, on which irradiation equipment and other equipment are mounted, e.g., a high-voltage cathode mounted on an isolator. Alternatively, the housing may further comprise non-conductive parts. In particular, the housing may consist of a plurality of mutually insulated conductive elements, which allows each insulated conductive element to be put on an electric potential independently of the other elements making up the housing.

It is noted that the second electrically conductive element may be a plurality of physically separate conductive elements which are separated from the first conductive element by a common bias voltage. Alternatively, the second conductive element may consist of a plurality of (or groups of) electrically conductive elements, which are connected to independent (but not necessarily distinct) electric potentials, so that they are separated by a plurality of independent bias voltages from the first conductive element.

The invention gives priority to electrostatic means rather than magnetic means for controlling or at least affecting the movement of the ionised particles, mainly because electrostatic or electric fields may influence charged particles independently of their energies. Conversely, because the electrons in the first electron beam typically travel much faster than the charged particles, it will be a more delicate task to design a magnetic field which efficiently prevents debris transport towards e.g. the cathode region or the X-ray window but does still not disturb the first electron beam to a significant level.

The first electron source, which also may be referred to as an electron gun, may comprise a cathode that is powered by a voltage supply and includes an electron source, such as e.g. a thermionic, thermal-field or cold-field charged-particle source. An electron beam may be accelerated towards an accelerating aperture, at which point it may enter an electron-optical system that may comprise an arrangement of aligning plates, lenses and deflection plates. Variable properties of the aligning means, deflection means, and lenses may be controllable by signals provided by a controller. The aligning means, deflection means, and lenses may comprise electrostatic, magnetic, and/or electromagnetic components. The electron-optical system(s) may be calibrated and operated to direct the first electron beam onto the target in the interaction region, and/or or direct the second electron beam to a region in the chamber wherein it may interact with particles.

The term "ion collection tool" may refer to structures and means that are capable of diverting, removing, collecting, storing or measure particles that otherwise would move freely inside the chamber or deteriorate the function of the X-ray source. Thus, the term "remove" may be replaced with "immobilise" ions in chamber. The ion collection tool may e.g. be formed of an inner wall of the chamber, at which the particles may adhere, and/or comprise a getter material for removing the particles. In some examples, the ion collection tool may refer to a combination of an electric field generator and an ion dump, wherein the electric field generator may be operable to generate an electric field that directs the particles to the ion dump. In some examples, the ion collection tool may comprise a magnetic lens for focusing or defocusing the first electron beam. An ion entering the magnetic field of this lens may be deflected away from the optical axis, particularly if the trajectory of the ion is not parallel to the magnetic field.

The term "particles" may refer to debris, vapour and other pieces of material in general, and in particular material that may migrate within the chamber and possibly have a negative impact on the functioning of the X-ray source. It will be appreciated that the term "particles" may, in the context of the present application, be interchangeably used with "debris".

According to an embodiment, the ionising tool is formed by a second electron source operable to emit a second electron beam comprising electrons of a second energy for ionising particles in the chamber. The second electron source may be similarly configured as the first electron source. The electrons of the second electron beam may pass through an electron-optical system that may comprise an arrangement of aligning plates, lenses and deflection plates. Variable properties of the aligning means, deflection means and lenses may be controllable by signals provided by a controller. The aligning means, deflection means, and/or lenses may comprise electrostatic, magnetic, and/or electromagnetic components. The electron-optical system may be calibrated and operated to direct the second electron beam to a region in the chamber wherein it may interact with particles.

The X-ray source is not limited to a single second electron source for ionising particles. In some examples, the X-ray source may, in addition to the first electron source, comprise an electron source directed towards the cathode region of the first electron source, and another electron source directed towards the X-ray window region.

It is however noted that the term "second electron source" may refer to any structure or feature capable of generating electrons for ionising particles in the chamber. The second electron source may e.g. be induced by the first electron source by letting the first electron beam impinge on a material that is apt to generate secondary emission electrons (or secondary electrons for short). If the yield in this process is larger than one, an avalanche effect could be achieved. These secondary electrons may e.g. be generated when the electrons of the first electron beam impact the target, and therefore ionise particles proximate to the interaction point.

The first electron source may be adapted to provide electrons having an energy that is suitable for generating X-ray radiation, such as e.g. 1 keV or higher, whereas the second electron source may be adapted to provide electrons having an energy that is suitable for ionising the particles in the chamber. X-rays may be emitted both as continuous Bremsstrahlung and characteristic line emission, wherein the specific emission characteristics may depend on the target material used. The electron energy for generating X-ray radiation may be selected depending on target material and geometry. To be able to produce X-ray line emission, the available energy should be larger than the energy required to knock out a K electron from the target material. A higher electron energy may result in more X-ray production since each impacting electron may knock out several target electrons. However, a larger energy may result in electrons penetrating deeper into the target material and thus a larger fraction of the generated X-ray photons is absorbed by target material before they can be emitted. In a gallium alloy liquid metal jet system the energy may be in the range 10 to 160 keV. Typically, the second energy may be lower than 1 keV to provide a relatively large cross section for interacting with the particles. This may e.g. correspond to a second energy in the range of 10 to 100 eV, depending on the material of the particles. 20 to 30 eV may e.g. be used for gallium, and 30 eV for indium.

According to an embodiment, the ion collection tool may be adapted to generate an electric field that is oriented transversally to the first electron beam, so as to allow for particles to be transported away from the path of the first electron beam.

The electromagnetic field used by the ion collection tool may e.g. be provided by coils or electrodes that are arranged rotationally symmetric with respect to the optical axis of the first electron source so as to further reduce the impact of electromagnetic field on the first electron beam.

In an embodiment the electromagnetic field used by the ion collection tool may comprise an electric field generated by a first electrically conductive element, a second electrically conductive element and an electric source operable to apply a nonzero bias voltage between the first and second conductive elements. The geometric configuration of the first and second conductive elements and the magnitude of the bias voltage may be selected in order for the resulting electric field to remove the ionised particles from the chamber. Ions typically have thermal energies (less than 1 eV), so a bias of a couple of hundreds volts may be sufficient to significantly alter the ion trajectory. In one example, the geometric configuration is selected to prevent charged particles from entering the cathode region and/or the X-ray window.

The target may comprise solid, liquid, or gaseous material. The invention is advantageous to use together with a re-generating target as in this case degradation of the target resulting in emission of debris particles can be tolerated without deterioration of the resulting X-ray performance.

According to a preferred embodiment, the X-ray source may further comprise a target generator that is adapted to generate a target in the form of a stream of a material, such as e.g. a gaseous or liquid jet, that propagates through the interaction region. The jet may e.g. be formed by urging a liquid substance, such as a liquid metal, under pressure through an outlet opening. The jet may be a high velocity jet propagating with a velocity of 10 m/s or above, or a low velocity jet propagating with a velocity of less than 10 m/s. As the jet is regenerative to its nature, there is no need for additional cooling of the target material. Thus, the electron beam power density at the target may be increased significantly compared to non-regenerative targets. The target material may e.g. be formed by a metal with low melting point, such as indium, tin, gallium, lead or bismuth, or an alloy thereof, exhibiting X-ray line radiation at a desirable energy. Alternatives realising the same advantages may include providing the target in the form of a concentrated gaseous jet.

According to an embodiment, the particles removed from the chamber may be used to resupply the target. In particular, the ion collection tool may be connected to a liquid jet material system for resupplying the collected material to the target generator. The ion collection tool, or ion dump, may e.g. comprise a smooth and/or slanting surface from which the ionised particles may be collected and recycled. Advantageously, the ion collection tool may comprise a surface that facilitates transport of the particles, such as e.g. debris from a liquid target, by means of capillary action. Further, capillary effects may be useful for reducing the surface roughness of surfaces that are electro-optically active. Transporting away the particles may e.g. help reducing the risk of formation of condensation droplets and bumps on the first electron source, which otherwise tend to skew the E-field distribution and misalign the electron beam over time. Surface smoothness may also be important for reliability of high voltage components. Droplets or condense tends to increase local E-field strength which can induce field emission and arcing and thus detoriate and prematurely stress and age high voltage equipment (generator, cabling, etc).

According to an embodiment, the second electron source may be operable to emit a diverging second electron beam. As the ionisation is considered to take place in the vicinity of the electron beam, a diverging beam may ionise more particles compared to a less diverging beam. Thus, the present embodiment may provide an X-ray source having an increased capability of ionising particles in the chamber. On the other hand, a smaller electron density may lower the ionisation cross section. Thus, if the location of the neutral particles is known it would be advantageous to focus the second electron beam on that location. A further embodiment would be to include a guiding electromagnetic field ensuring that the electrons emitted from the second electron source travel along a path increasing the probability that they will encounter a neutral particle, e.g. a circular or helical path in the vicinity of the interaction region or the X-ray window.

It is noted that the invention relates to all combinations of the technical features outlined above, even if they are recited in mutually different claims. Thus, any of the features described according to the first aspect above may be combined with the method according to the second aspect of the present invention.

Further objectives of, features of, and advantages with the present invention will become apparent when studying the following detailed disclosure, the drawings and the appended claims.

BRIEF DESCRIPTION OF THE DRAWINGS

The invention will now be described for the purpose of exemplification with reference to the accompanying drawings, on which.

All the figures are schematic, not necessarily to scale, and generally only show parts that are necessary in order to elucidate the invention, wherein other parts may be omitted or merely suggested.

DETAILED DESCRIPTION OF EMBODIMENTS

Figure 1:
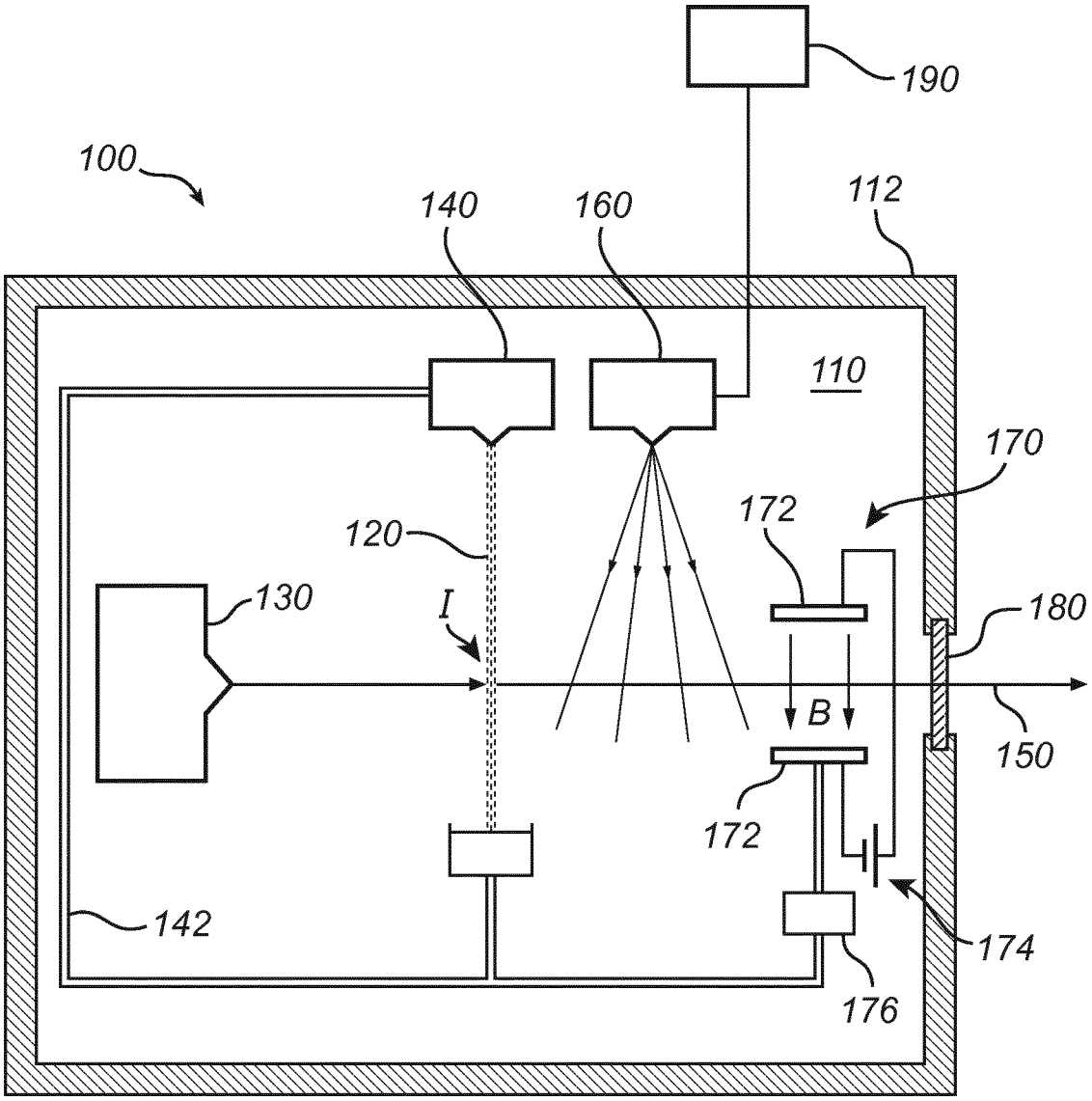
FIGS. 1-3 are schematic, cross sectional side views of X-ray sources according to some embodiments of the present invention.

An X-ray source 100 according to an embodiment of the invention will now be described with reference to FIG. 1. As indicated in FIG. 1, a vacuum chamber 110 may be defined by an enclosure 112 and an X-ray transparent window 180 that separates the vacuum chamber 110 from the ambient atmosphere. The X-rays 150 may be generated from an interaction region I, in which electrons from a first electron beam may interact with a target 120.

The electron beam may be generated by a first electron source 130, such as an electron gun 130 comprising a high-voltage cathode, directed towards the interaction region I.

According to the present embodiment, the target 120 may e.g. be formed of a liquid jet 120 intersecting the interaction region I. The liquid jet 120 may be generated by a target generator 140 comprising a nozzle through which e.g. a gas or a liquid, such as e.g. liquid metal may be expelled to form the jet 120 propagating towards and through the interaction region I.

The X-ray source 100 may further comprise a closed-loop circulation system 142 located between a collection reservoir for collecting the material of the liquid jet 120 and the target generator 140. The closed-loop system 142 may be adapted to circulate the collected liquid metal to the target generator 140 by means of a high-pressure pump adapted to raise the pressure to at least 10 bar, preferably at least 50 bar or more, for generating the target jet 120.

Further, the X-ray source may comprise an ionisation tool 160 adapted to ionise particles in the chamber 110. The ionisation tool 160 may e.g. be formed of a second electron source 160 that may be operable to emit one or several second electron beam(s), preferably independently from the operation of the first electron source 130, comprising electrons of a second energy suitable for ionising e.g. debris that may be generated upon the interaction between the first electron beam and the target material. In the example illustrated by the present figure, the second electron source 160 may comprise an electron emitter, one or several anode electrodes, and a deflector. The second electron source 160, or electron gun, may be arranged to emit at least one electron beam in a direction intersecting the direction of the first electron beam, i.e., oriented transversally to the first electron beam. Further, the transversal second electron beam may be oriented to interact with particles at a position between the X-ray window 180 and the interaction region I, so that particles may be ionised on their way from the interaction region I towards the X-ray window 180. Furthermore, a guiding electromagnetic field (not shown) may be provided ensuring that the electrons emitted from the second electron source travel along a path increasing the probability that they will encounter a neutral particle, e.g. a circular or helical path in the vicinity of the interaction region or the X-ray window.

The X-ray source 100 may further comprise a controller 190 or controlling circuitry 190 that may be operably connected to the ionising tool 160. The controller 190 may be configured to control the operation of the ionising tool 160 and allow e.g. the second electron beam to be directed at a desired position. It will also be appreciated that the controller may be further connected to e.g. the ion collection tool or a particle sensor (not shown) to retrieve a measure of the number of ionized particles generated in, or present in, the chamber 110. This measure may e.g. be used as input when controlling the operation of the ionising tool.

FIG. 1 also indicates that the X-ray source 100 may comprise an ion collection tool 170 for removing, or at least immobilising, ionised particles. The collection tool 170 may utilise an electromagnetic field E for controlling, or at least affecting, the movement of the particles. The electromagnetic field E may e.g. be provided with a transversal component relative to the optical axis of the X-ray source, so that charged particles may be deflected away from trajectories that lead up to e.g. the X-ray window 180 or the first electron source 130. The electromagnetic field E may be generated between two electrodes 172, which e.g. may be formed of a first and a second electrically conductive plate arranged at opposing sides of the optical axis. A bias voltage may be applied to the electrodes 172 by means of a voltage source 174 that is electrically connected to the electrodes 172.

In the present embodiment, one of the electrodes 172 may be combined with an ion collector, or ion dump 176, adapted to collect the ionised particles. Thus, the charged particles may be captured by the electric field E and directed towards the ion collector 176 at which they may be trapped or collected by means of e.g. condensation, electrostatic attraction and/or a getter material. Further, the ion collector 176 may be connected to the closed-loop recycling system 142 such that the collected particles may be reused in the generation of the target 120. Alternatively, or additionally, the ion collector 176 may be combined with a measuring device (not shown) for measuring an amount of collected particles. The measuring device may e.g. comprise a current measuring device, such as an ammeter, for measuring the electric current produced by the charged particles, thus providing a measure of the ionization rate within the chamber. The measuring device may further be connected to the controller 190.

Figure 2:
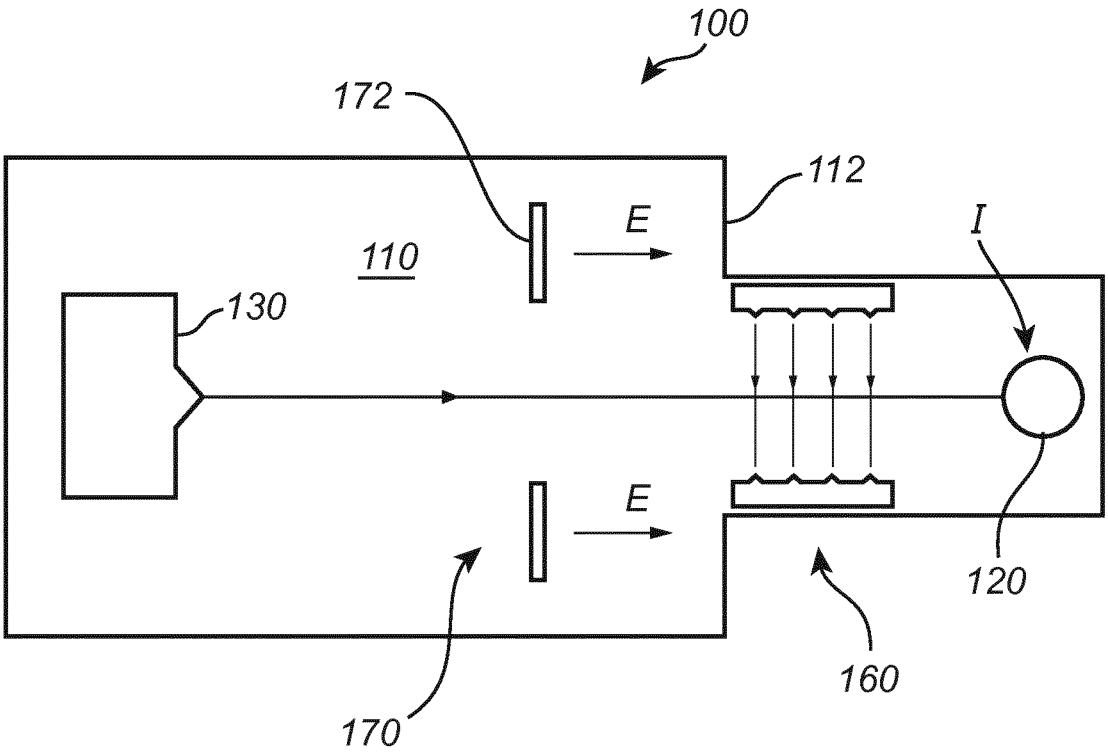

FIG. 2 discloses an X-ray source according to an embodiment that may be similarly configured as the embodiment described with reference to FIG. 1. In the present embodiment, the ion collection tool 170 may be arranged to generate an electric field E along the direction of the first electron beam. The electric field may preferably be generated by means of a rotationally symmetric electrode 172. With this setup, the electric field will disturb the first electron beam to a limited extent or in a way that can be easily compensated for by defocusing or refocusing. In particular, the primary effect of a rotationally symmetric electrode is to change the divergence of the electron beam. In the present example, the ion collection tool 170 comprises an electrode 172 having an aperture through which the first electron beam may propagate on its way to the target 120 (which may be an arbitrary target, such as e.g. a stationary solid target or a liquid jet target). Depending on the size of the aperture, the first electrode 172 may thus form a mechanical shield preventing at least some particles from propagating towards the first electron source 130. Further, the geometric configuration of the ion collection tool 170 and the magnitude of the bias voltage may be selected in order for the resulting electric field E to prevent charged particles from entering the region of the first electron source 130 via the aperture. The bias voltage to be applied to generate the electric field E is to be selected in such manner that the act of moving a singly charged positive ion with a kinetic energy below a maximum energy from the interaction region I through the electric field E to the aperture of the electrode 172 requires a work greater than said maximum energy. In other words, a parallel electric field may be designed such that it realises an energy threshold high enough to stop all ions with kinetic energies below the maximum energy.

It will however be realised that the conductive element or electrode may be arranged inside an aperture of a shield that does not form part of the electric field generating means. As indicated in the present figure, the electric E field may be generated between an electrode 172 and a portion of the housing, which may be kept at ground potential or at any other potential suitable for generating a desired electric field E.

Further, the ionisation tool 160 may comprise a plurality of second electron sources arranged to irradiate particles passing between the interaction region I and the first electron source 130. The ionisation tool 160 may e.g. be arranged in a passage between the interaction region I and the ion collection tool 170.

Figure 3:
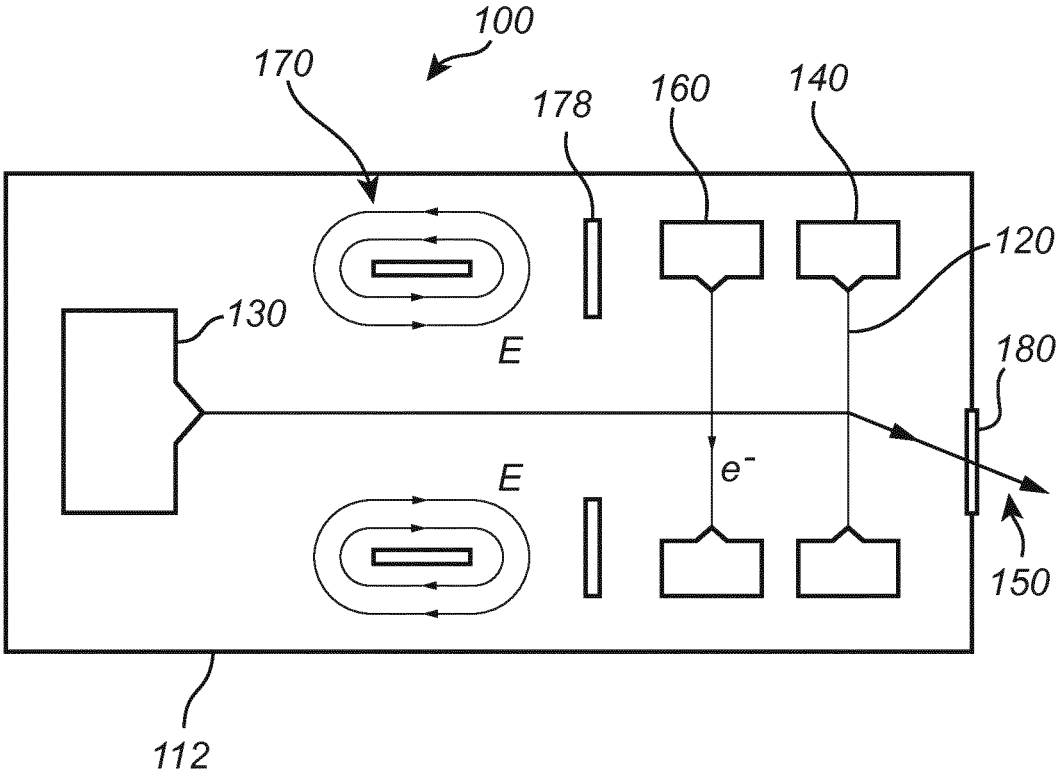

FIG. 3 illustrates an X-ray source 100 that may be similar to the embodiments described in connection to FIGS. 1 and 2, wherein the ionising tool (comprising e.g. a second electron source 160) is arranged upstream of the interaction region I, as seen from the first electron source 130. As indicated in the present figure, one or several electric coils 170 may be arranged to at least partly enclose the first electron beam. In FIG. 3, a cross section of a coil is indicated, wherein the coil 170 may be configured to generate a magnetic field B that may be parallel with the optical axis of the X-ray source 100. The coil 170 may form part of an electron-optical system for controlling and improving a quality of the electron beam. Alternatively, or as a consequence, the coil 170 may be arranged to deflect at least some charged particles entering the coil. Referring to the example illustrated by the present figure, charged particles having a trajectory that is non-parallel to the magnetic field B may interact with the magnetic field within the coil 170 such that they may be prevented from reaching the first electron source 130. Particles travelling along the optical axis may however be less affected by the coil 170, since they travel along the magnetic field B. They may on the other hand be bombarded by electrons of the first electron source and possibly be given a non-zero velocity component perpendicular to the optical axis.

Further, an ion dump 178 or aperture, which e.g. may be a negatively charged plate, may be arranged upstream of the coil 170 to collect at least some of the particles that are deflected by the magnetic field B. Thus, particles generated in the vicinity of the target 120 need to pass the magnetic field B and the aperture of the ion dump 178 before they reach the first electron source 130.

According to an embodiment, the magnetic field B as e.g. shown in FIG. 3 may be combined with an electric field with an orientation similar to what is shown in FIG. 2. In that case the ion dump 178 may be replaced with e.g. a rotationally symmetric electrode having an aperture through which the first electron beam may propagate on its way to the target.

Figure 4:
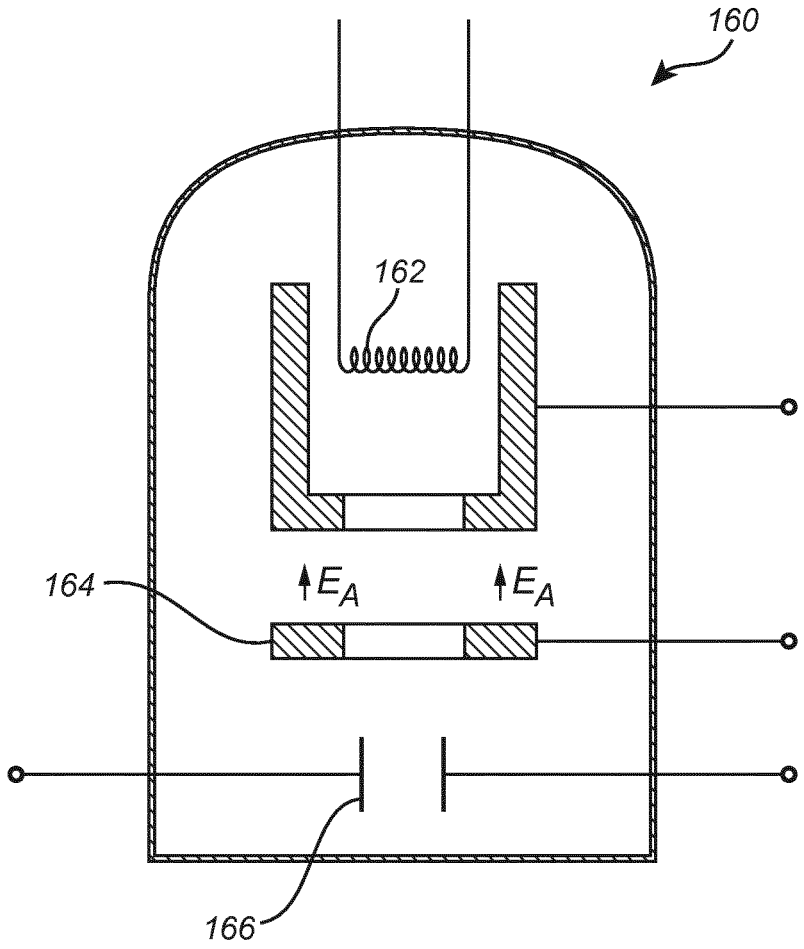
FIG. 4 is a cross sectional side view of a second electron source according to an embodiment.

FIG. 4 is a cross section of a second electron source 160 according to an embodiment. The electron source 160 may be similarly configured as the ionising tool discussed in connection with the previous figures. The second electron source 160 may comprise an electron emitter 162, such as e.g. a filament 162, which may be configured to emit electrons when heated by a heater current. Further, an anode arrangement 164 may be provided in order to generate an electric field EA for accelerating the emitted electrons. The emitted electrons may then pass a deflector arrangement 166, which e.g. may be formed of a plurality of plates for directing the electron beam in different directions. Even though not illustrated in the present figure, the controller may be arranged to control the heater current, the acceleration potential and/or the deflector 166 so as to provide a second electron beam having the desired properties for ionising particles in the chamber.

Figure 5:
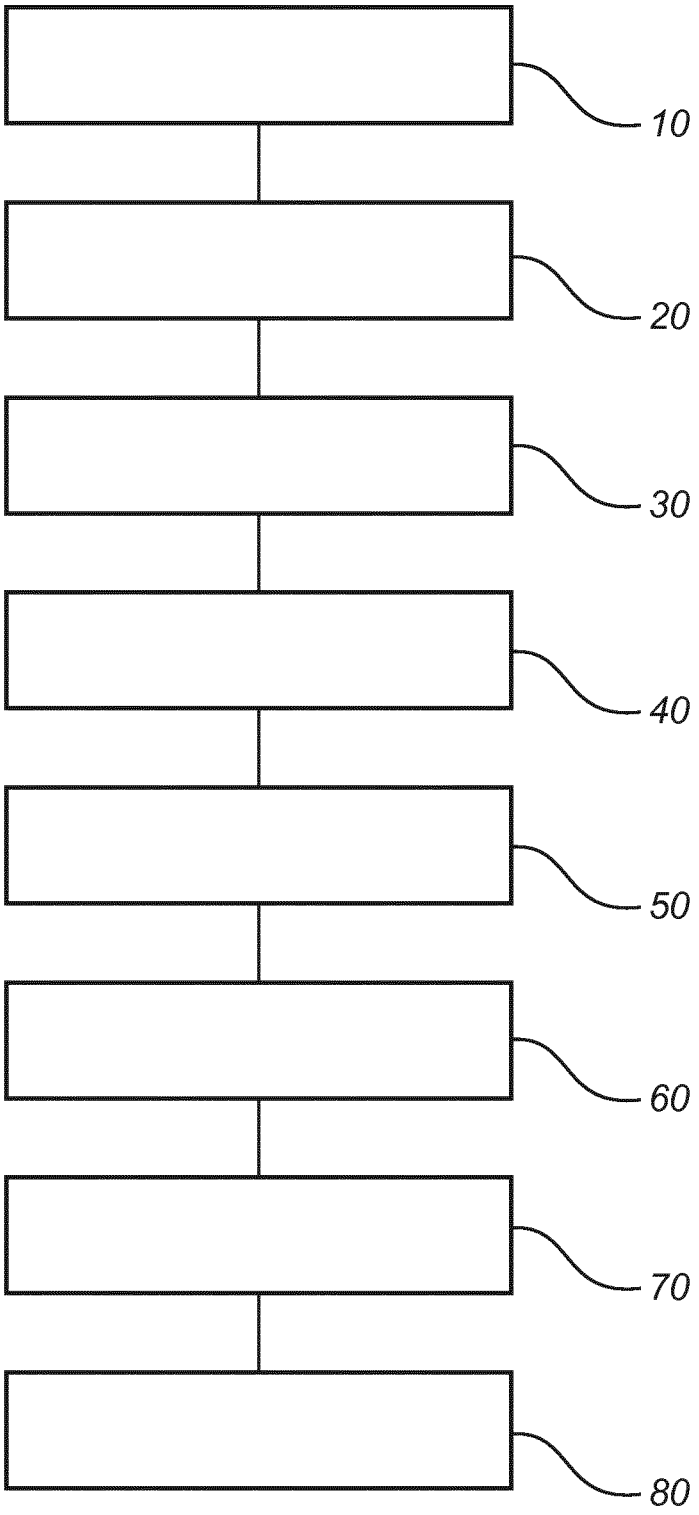
FIG. 5 schematically illustrates a method for generating X-ray radiation according to an embodiment of the present invention.

FIG. 5 is a flowchart illustrating a method for generating X-ray radiation according to an embodiment of the present invention. The method may comprise the steps of forming 10 a stream of a target material propagating through the interaction region I in the chamber 110 so as to form the target 120, and directing 20 a first electron beam, comprising electrons of a first energy, towards the interaction region I such that the electron beam interacts with the target 120 to generate X-ray radiation. The method may further comprise the steps of ionising 30 particles in the chamber, and removing 40 the ionised particles from the chamber 110 by means of an electric field E. The steps of ionising 30 particles may, in some embodiments, comprise the step of directing 30 a second electron beam comprising electrons of a second energy suitable for ionising the particles, such that the second electron beam interacts with debris generated from the interaction between the first electron beam and the target, thereby ionising at least some of the particles in the chamber. The method may further comprise the steps of collecting 50 the ionized particles, measuring 60 a rate at which ionized particles are collected, and adjusting 70 said second electron beam so that the rate is increased. In yet a further embodiment the method may comprise the step of resupplying 80 the particles removed from the chamber to the target. For embodiments comprising the step of forming 10 a stream of a target material propagating through the interaction region I in the chamber 110 so as to form the target 120 comprising the method may further comprise a step of resupplying 80 the collected particles to the stream of target material.

The person skilled in the art realises that the present invention by no means is limited to the example embodiments described above. On the contrary, many modifications and variations are possible within the scope of the appended claims. For example, the ionisation tool and/or the electrodes of the ion collection tool may be arranged in other geometric positions. The applied electromagnetic field need not be purely axial or purely transversal, but may be oriented in different ways provided it is effective in limiting the mobility of debris particles, notably by accelerating them away from sensitive parts the X-ray source or immobilising them by adsorption onto a surface or in an ion dump. In particular, the ionisation tool and/or the electromagnetic field may be deployed in a time varying fashion, which provides for more sophisticated ways of diverting debris particles from sensitive parts (e.g. the X-ray window or the cathode) into regions where they are harmless. Time-varying deployment may also be used to clear the irradiation region from freely moving debris more thoroughly at periodic intervals.

Additionally, variations to the disclosed embodiments can be understood and effected by the skilled person in practicing the claimed invention, from a study of the drawings, the disclosure, and the appended claims. In the claims, the word "comprising" does not exclude other elements or steps, and the indefinite article "a" or "an" does not exclude a plurality. The mere fact that certain measures are recited in mutually different dependent claims does not indicate that a combination of these measures cannot be used to advantage.

The invention claimed is:

1. An X-ray source comprising:

a chamber comprising an interaction region;

a first electron source operable to emit a first electron beam, comprising electrons of a first energy, towards the interaction region such that the first electron beam interacts with a target to generate X-ray radiation;

a second electron source adapted to be independently operated to emit a second electron beam comprising electrons of a second energy for ionising particles in the chamber; and an ion collection tool adapted to remove the ionised particles from the chamber by means of an electromagnetic field;

wherein said first electron source comprises a first electron emitter and a first anode electrode for generating a first acceleration potential;

wherein said second electron source comprises a second electron emitter, a second anode electrode for generating a second acceleration potential, and a deflector;

wherein the first energy is 1 keV or higher and the second energy is lower than 1 keV.

2. The X-ray source according to claim 1, wherein said second electron emitter comprises a filament for emitting electrons when heated by a heater current.

3. The X-ray source according to claim 2, further comprising a controller arranged to adjust at least one of said heater current, said second acceleration potential, and said deflector.

4. The X-ray source according to claim 3 wherein the ion collection tool is arranged to provide a measure of the number of ionized particles and wherein said controller is arranged to control the second electron source to increase said measure.

5. The X-ray source according to claim 1, wherein the ion collection tool comprises a getter material.

6. The X-ray source according to claim 1, wherein the ion collection tool comprises a conductive element for generating the electromagnetic field directing the ionised particles towards an ion dump.

7. The X-ray source according to claim 1, wherein the ion collection tool is adapted to generate an electric field that is oriented transversally to the first electron beam.

8. The X-ray source according to claim 1, wherein said electromagnetic field is arranged rotationally symmetric with respect to an optical axis of the first electron source.

9. The X-ray source according to claim 1, further comprising a target generator adapted to form a stream of a target material propagating through the interaction region so as to form the target.

10. The X-ray source according to claim 9, wherein the target is formed of a liquid metal jet.

11. The X-ray source according to claim 10, wherein the ion collection tool is connected to a liquid jet material system for resupplying the material to the target generator.

12. The X-ray source according to claim 1, further comprising an X-ray window, wherein the second electron source is adapted to direct the second electron beam towards the X-ray window.

13. A method for generating X-ray radiation, comprising the steps of:

directing a first electron beam, comprising electrons of a first energy, towards an interaction region in a chamber such that the electron beam interacts with a target to generate X-ray radiation;

directing by means of a deflector, independently from the first electron beam, a second electron beam comprising electrons of a second energy for ionising particles in the chamber, such that the second electron beam interacts with debris generated from the interaction between the first electron beam and the target, thereby ionising at least some of the particles in the chamber; and wherein said first electron beam is generated using a first electron source comprising a first electron emitter and a first anode electrode for generating a first acceleration potential;

wherein said second electron beam is generated using a second electron source comprising a second electron emitter and a second anode electrode for generating a second acceleration potential;

wherein the first energy is 1 keV or higher and the second energy is lower than 1 keV.

14. The method according to claim 13, further comprising collecting the ionized particles, measuring a rate at which ionized particles are collected, and controlling said second electron beam so that the rate is increased.

15. The method according to claim 13, further comprising forming a stream of a target material propagating through the interaction region in the chamber so as to form the target.

16. The method according to claim 15, further comprising resupplying the collected particles to the stream of target material.

17. The method according to claim 13, further comprising resupplying the particles removed from the chamber to the target.

* * * * *